United States Patent [19]

Bubendorff

[11] Patent Number: 4,760,873

[45] Date of Patent: Aug. 2, 1988

[54] ROLLING SHUTTER FOR ROOF WINDOW

[76] Inventor: Richard Bubendorff, Rue des Acacias, 68220 Hegenheim Haute-Rhin, France

[21] Appl. No.: 913,345

[22] Filed: Sep. 30, 1986

[30] Foreign Application Priority Data

Oct. 23, 1985 [FR] France ..... 85 15936
Jan. 8, 1986 [FR] France ..... 86 00246

[51] Int. Cl.[4] ..... E04F 10/06
[52] U.S. Cl. ..... 160/32; 160/133
[58] Field of Search ..... 160/32, 33, 35, 31, 160/29, 30, 23 R, 133

[56] References Cited

U.S. PATENT DOCUMENTS

| | | | |
|---|---|---|---|
| 2,173,900 | 9/1939 | Dunn | 160/133 X |
| 3,522,834 | 8/1970 | Corcoran | 160/23 R |
| 3,878,879 | 4/1975 | Manns | 160/23 R X |
| 4,565,231 | 1/1986 | Moessner et al. | 160/133 |
| 4,628,646 | 12/1986 | Eyerle | 160/133 X |

FOREIGN PATENT DOCUMENTS

| | | | |
|---|---|---|---|
| 0145628 | 6/1985 | European Pat. Off. . | |
| 2504682 | 8/1976 | Fed. Rep. of Germany . | |
| 2842381 | 4/1980 | Fed. Rep. of Germany | 160/33 |
| 2906871 | 9/1980 | Fed. Rep. of Germany . | |
| 3115926 | 11/1982 | Fed. Rep. of Germany | 160/33 |
| 3220138 | 12/1983 | Fed. Rep. of Germany . | |
| 2543610 | 10/1984 | France | 160/23 R |

*Primary Examiner*—Ramon S. Britts
*Assistant Examiner*—David M. Purol
*Attorney, Agent, or Firm*—Sandler & Greenblum

[57] ABSTRACT

A rolling shutter for being pivotably mounted on a roof window. The rolling shutter is provided with an apron, a shaft on which the apron is wound and from which it is unwound, another shaft for winding and unwinding the apron, a guide located between the two shafts, and a damping element; the damping element serves to maintain the rolling shutter in the position to which it is pivoted. The guide reverses the winding direction of the apron between the two shafts.

11 Claims, 3 Drawing Sheets

ROLLING SHUTTER FOR ROOF WINDOW

BACKGROUND OF THE INVENTION

1. Field of the Invention

This invention relates in general to rolling shutters and has specific reference to a rolling shutter for roof window, of the type comprising an apron movable in a substantially horizontal plane and made of blades having their lateral ends slidably engaged in guide rails constituting the prolongation of a casing rigidly fixed to the sash-frame of the rolling shutter, this casing enclosing a first shaft for rolling-up and/or unrolling the apron and another shaft constituting the drive shaft disposed downstream of said first shaft and provided at either ends with a cam wheel having an angular backlash consistent with the variable pitch existing between the dogs of two adjacent blades of said apron.

2. The Prior Art

It is already known through the document EP-A-O No. 145,628 to provide a roof window rolling shutter comprising an apron movable in a substantially horizontal plane and made of a plurality of blades having their lateral ends slidably engaged in lateral guide rails in prolongation of a casing rigid with the sash-frame of the rolling shutter and enclosing a first shaft for rolling-up and/or unrolling the apron and a second shaft disposed downstream of said first shaft, said second shaft being provided at either end with a cam wheel having an angular backlash consistent with the variable pitch existing between the dogs of two adjacent blades of said apron.

In this known structure the casing bottom is connected to the guide rails by means of a ramp on which the apron blades are adapted to slide upwards toward the rolling-up and/or unrolling shaft, the contact generatrix being disposed in the lower portion of this shaft.

However, this rolling shutter cannot be used for equipping roof windows comprising a sash of the type pivoting about a horizontal hinge axis. In fact, the apron cannot be rolled up unless the central longitudinal axis of the winding shaft is raised with respect to the guide rails. Now this requirement implies a considerable increment in the overall height of the casing. On the other hand, for obvious lighting reasons, roof windows have a frame projecting more or less above the roofing surface, a feature constituting an interference to the free flow of rainwater and/or snow. Thus, this obstacle is aggravated by the presence of a relatively high casing, and the inconvenience of a defective flow of rainwater and/or snow is increased considerably.

Besides, when a foreign body such as a stone or the like is deposited on the apron, it is carried towards the winding shaft and liable to be wedged between two adjacent turns of the apron. Thus, the diameter of the rolled-up portion of the apron is increased unduly and the casing is too small to accomodate this increment. Under these conditions, the apron is damaged or jammed, and cannot be driven freely.

SUMMARY OF THE INVENTION

It is the primary object of the present invention to avoid the various inconveniences set forth hereinabove by providing an improved rolling shutter for roof windows which comprises, beyond the top edge of the upper cross member of the roof window sash frame, a casing having a bottom disposed at a level lower than that of the top surface of said sash frame and adapted to pivot about a hinge axis disposed at the lower edge of its upper end upstream of the rolling-up and/or unrolling shaft (referred to hereinafter as the first shaft), said casing enclosing means for forcibly guiding the apron, said forced guide means being interposed between said rolling-up and unrolling or first shaft and said drive shaft (referred to hereinafter as the second shaft), adapted to reverse the apron curvature between said first and second shafts, and a sash frame connected through lugs to the longitudinal members of the roof window sash frame and provided with damping means disposed at the lower end of the lateral guide rails.

The advantages deriving from the present invention result essentially from the fact that the roof window is provided with a rolling shutter of which the height of the portion projecting above the casing in relation to the top of the sash frame of the roof window is reduced appreciably. Thus, any detrimental or important stagnation of rainwater and/or snow above the top edge of the roof window equipped with this rolling shutter is safely avoided. On the other hand, the presence of damping means compensating either the weight of the rolling shutter alone or the total weight of this shutter and of the sash frame avoid any sudden fall of the rolling shutter during the pivotal povement of the window about its hinge axis.

Moreover, any foreign bodies having escaped the clearing action of the brush are prevented from penetrating between adjacent turns of the apron, so that the winding diameter of the apron remains constant. In fact, foreign bodies driven into the casing are caused to either slide towards the drive shaft or, after reaching the topmost generatrix of the winding diameter, fall at the rear end of this bottom. If necessary, this bottom may comprise an aperture permitting the removal of any foreign bodies.

A typical and advantageous form of embodiment of this invention comprises means for forcibly guiding the apron, in the form of two lateral guide members cooperating with the lateral ends of the apron blades provided for this purpose with suitable dog means.

According to another feature characterising the present invention, said lateral guide members comprise an ascending curvilinear section partially encompassing the cam wheels of the drive shaft. Thus, the meshing engagement between the cam wheels and the apron blades can take place on a greater angular extent.

This arrangement provides an additional advantage in that the driving force exerted the on apron is increased considerably. Therefore, it is possible to drive the apron not only along a slope but also vertically, since the apron blades can assume a vertical position.

Another application of this invention is obtained through an arrangement enabling the drive dogs to slip on a ramp supporting lateral guide members, thus preventing any deflexion of the drive dogs.

Thus, the drive dogs have a resistance capable of overcoming the driving torque of the drive shaft. Under these conditions, in case of failure of the apron operation due to the presence of an obstacle upstream or downstream the drive shaft, the drive dogs will cause the motor to slip and the drive shaft to come to a standstill. Consequently, the apron is not actuated.

A clearer understanding of the present invention will be had from the following description of a typical form of embodiment thereof given with reference to the accompanying drawings.

THE DRAWINGS

FIG. 1 is a fragmentary elevational and sectional view of the upper portion of the rolling shutter according to the instant invention, FIG. 2 is a fragmentary plane view showing the upper end of the rolling shutter, FIG. 3 is a fragmentary elevational view showing the lower end of the rolling shutter provided with damping means, FIG. 4 illustrates in fragmentary and plane view the lower end of the rolling shutter, FIG. 5 is an elevational and sectional view showing on a larger scale the casing of the rolling shutter, FIG. 6 is a section taken along the line VI—VI of FIG. 5, and FIG. 7 is a complete elevational view showing the position of the damping means when the rolling shutter of the invention and the hinged leaf are simultaneously raised from the sash-frame.

DESCRIPTION OF THE PREFERRED EMBODIMENT

Figure 3:
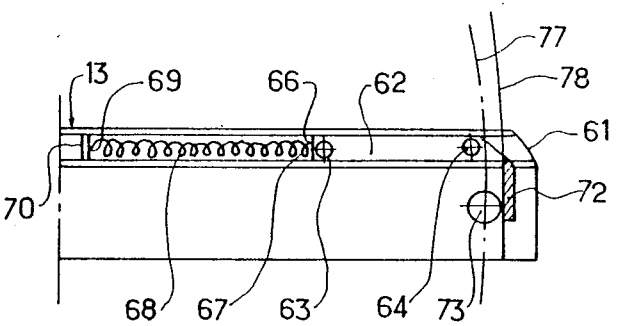
Figure 4:
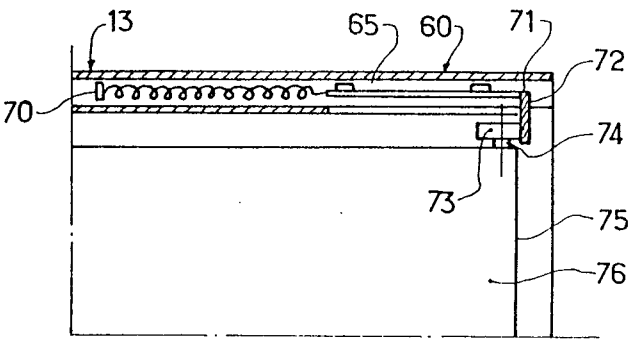
Figure 1:
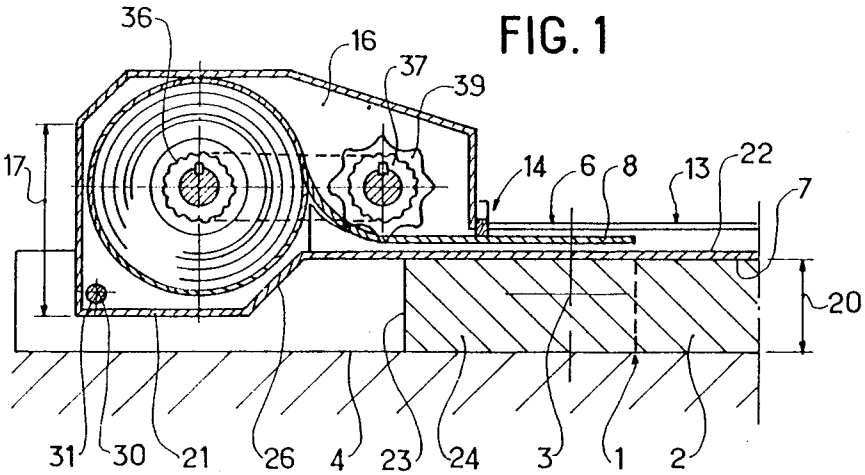
Figure 2:
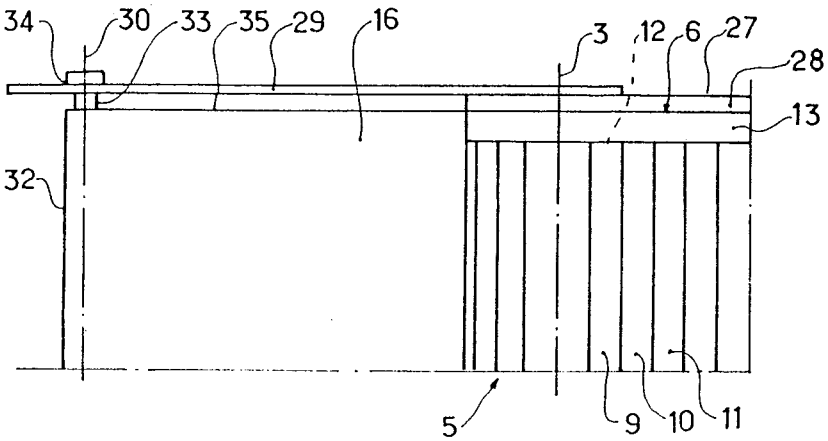
Figures 5, 6:
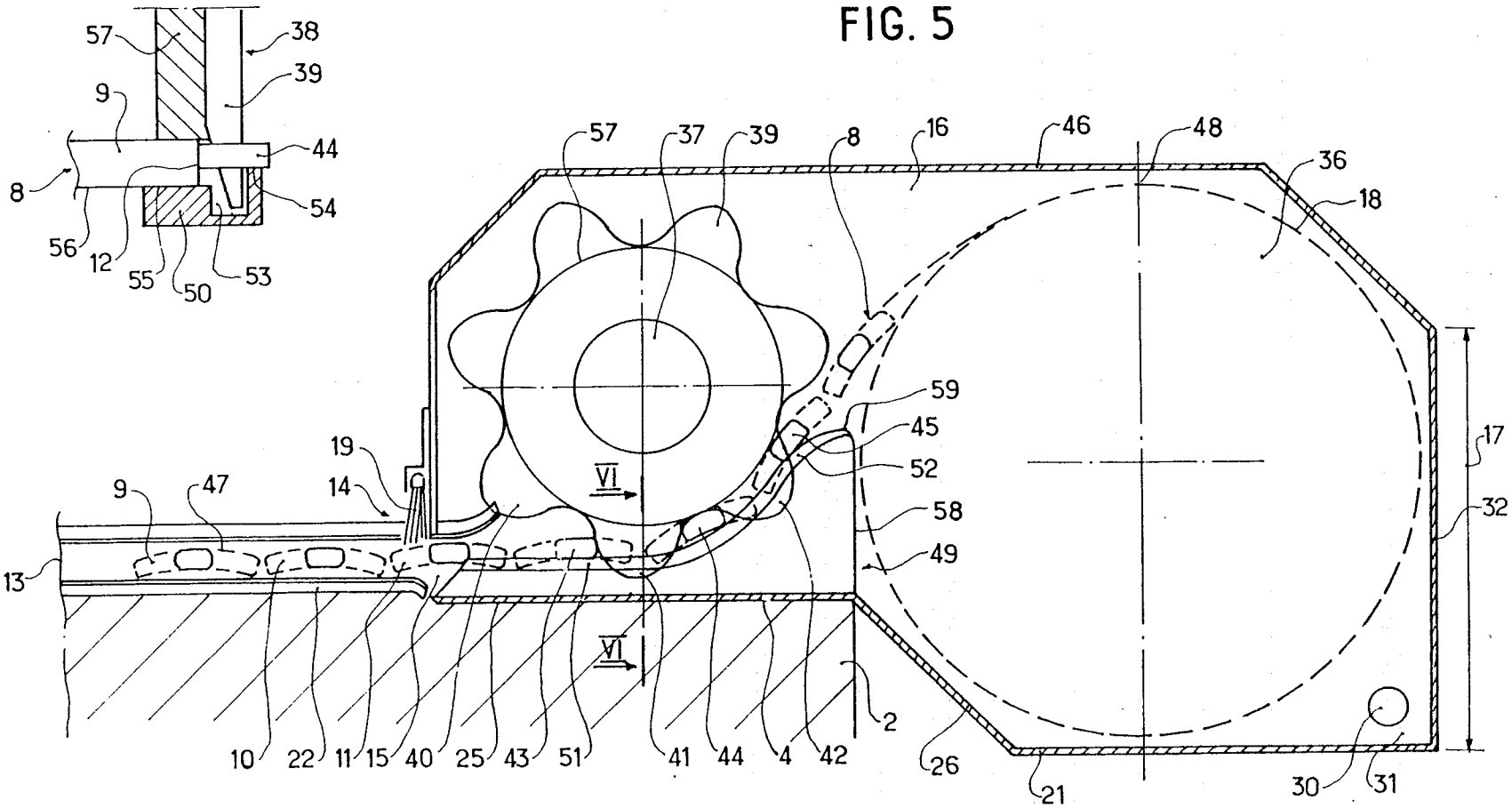
Figure 7:
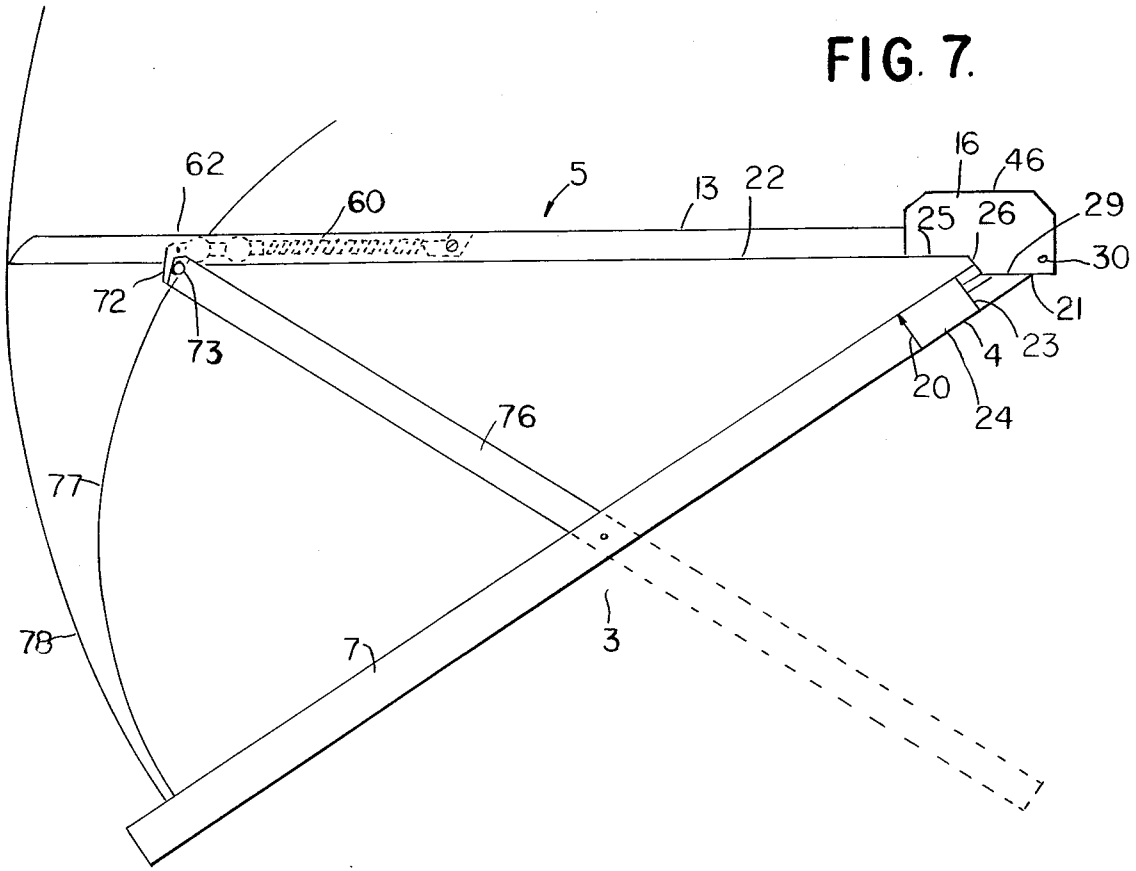

Referring first to FIGS. 1, 2 and 4 of the drawings, the improved rolling shutter according to the present invention is associated with a roof window 1 comprising essentially a sash frame 2 and a sash, or hinged leaf 76 arranged to open on hinges at the side, that is, by pivoting about a horizontal axis 3. This invention is concerned more particularly with roof windows of the type projecting somewhat above the top 4 of the roofing.

According to this invention, this roof window 1 is provided with a rolling shutter 5 comprising an apron 8 consisting of a plurality of parallel blades 9, 10, 11 . . . . The lateral ends 12 of the apron blades 9, 10, 11 . . . are slidably engaged in lateral guide rails 13 having their lower ends (not shown) interconnected by a cross member also acting as a stop member to the apron 8. The upper ends 14 of guide rails 13 abute that inlet/outlet aperture 15 of a casing 16. Since this casing 16 is intended for enclosing the apron 8 in its fully rolled-up condition, its height 17 must necessarily be slightly greater than the winding diameter 18 of the rolled-up apron 8 to provide a free gap for the passage of foreign matters such as leaves, stones or the like possibly carried along into the casing 16 in spite of the presence of a brush 19 disposed at the inlet 15 of said casing 16.

However, it is advantageous that the height of the roof window 1 above the sash frame 2 be as small as possible to avoid an excessive stagnation of water and/or snow upstream of the casing 16. For this purpose, it is contemplated to utilize at least partially the height 20 of the projecting portion of the sash frame 2 of roof window 1. Therefore, the bottom 21, according to a specific feature of the present invention, is advantageously disposed at a lower level than that of the extension of the bottom wings 22 of the lateral guide rails 13, and consequently below the top surface of the sash frame 2 of window 1. As a result of this specific structure and arrangement of casing 16, this casing can be disposed beyond the top edge 23 of the upper cross member 24 of said sash frame 2 of roof window 1.

The casing 16 comprises another bottom wall 25 disposed in prolongation of the bottom wing 22 of said lateral guide rails 13 connected by an inclined wall portion 26 to the casing bottom 21.

To hold the rolling shutter 5 in position the casing 16 is disposed between a pair of lugs 29 secured to the outer faces 27 of the longitudinal members 28 of said rolling shutter 5 of roof window 1. Thus, the rolling shutter 5 is firmly coupled to the sash frame 2 of roof window 1.

In certain cases it may be desired to raise the rolling shutter 5. This requirement involves the possibility for the rolling shutter 5 to pivot about a hinge axis 30 parallel to the pivot hinge axis 3 of the sash frame. According to the present invention, this axis 30 of the sash frame, which acts at the same time as a means for interconnecting the casing 16 and lugs 29, is located at the lower corner 31 of the outer end face 32 of casing 16. This particular position of the hinge axis 30 permits of raising and lowering the complete rolling shutter assembly 5 when required.

According to a first form of embodiment, this axis of rotation 30 is a pivot shaft extending through the casing 16 and having its ends 33 housed in bearings 34 attached to the lugs 29.

According to another form of embodiment, this axis of rotation 30 consists of a pair of stub shafts projecting outwards from the side walls 35 of casing 16 and engaging bearings 34. Thus, the central portion located between the two lateral walls 35 will be free of any obstacle likely to interfere with the apron 8.

The means implemented for rolling up and/or unrolling the apron 8 are the same as those used with rolling shutters wherein the apron is movable in a substantially horizontal plane. Rotatably mounted in the casing 16 are a first shaft 36 for rolling up and unrolling the apron 8 and a drive shaft 37. This drive shaft 37 is parallel to, and disposed downstream of, the apron winding shaft 8. This drive shaft 37 is furthermore rotatably solid with the output shaft of an electric motor (not shown). Each lateral end 38 of drive shaft 37 has a cam wheel 39 keyed thereto, and a predetermined backlash is provided between the various star-forming radial arms or teeth 40, 41, 42 . . . of cam wheels 39. These cam wheels 39 are adapted to drive the apron 8 by engaging drive means in the form of dogs 43, 44, 45 . . . projecting from the lateral ends 12 of blades 9, 10, 11 . . . . The apron 8 is caused to pass under the drive shaft 37.

According to a specific feature of the present invention the apron 8, as its slides along the bottom wall 25 of casing 16, is diverted upwardly so as to be wound downwards around the rolling-up and unrolling shaft 36. Thus, in case one or more stones penetrated into the casing 16, they will either slide along the top 47 of apron 8 or, if they are carried along beyond the topmost generatrix 48 of winding diameter 18, towards the bottom wall 21. If desired, this bottom wall 21 may have an aperture formed therein for discharging foreign bodies or substances, this aperture being either constantly open or adapted to be closed by a detachable or pivoting cover. For this purpose, it is necessary that the apron 8 travels over the rolling-up and/or unrolling shaft 36 and that the curvature of the apron 8 be inverted since this apron moves firstly under the drive shaft 37.

For this purpose, the present invention provides forced guide means 49 in the form of a pair of lateral guide members 50 disposed between the rolling-up and/or unrolling shaft 36 and the drive shaft 37. These lateral guide members 50 comprise a straight section 51 parallel to the bottom wall 25 of casing 16. This straight section 51 has an ascending curvilinear extension 52 of such configuration as to follow partially the contour of cam wheels 39. Thus, a plurality of dogs 43, 44, 45 are caused to engage several radial arms 41, 42 of cam wheels 39 and consequently the force with which the apron 8 is driven is increased considerably. The radial arms 40, 41, 42 of cam wheels 39, during the rotation of drive shaft 37, protrude into a groove 53 formed in said lateral guide members 50. This groove 53 is located, in the transverse plane of said lateral guide members 50, between a supporting ramp 54 and a flat bearing surface 55. The dogs 43, 44, 45 are caused to slide on said supporting ramp 54 and the bottom surfaces 56 of the shutter blades 9, 10, 11 are slidably supported by said bearing surface 55.

Since the dogs 43, 44, 45 bear on the supporting ramp 54, any tendency of the shutter blades 9, 10, 11 and/or of the dogs 43, 44, 45 to sag is safely avoided while consolidating the bond between said dogs and the lateral ends 12 of blades 9, 10, 11.

Presser means 57 are provided on drive shaft 37 for maintaining the contact between the supporting ramp 54 and the dogs 43, 44, 45 of the shutter blades 9, 10, 11. According to a first form of embodiment, said presser means 57 consist of a resilient sleeve slipped on, and rotatably coupled to, drive shaft 37. This resilient sleeve is thus adapted to exert an elastic pressure on the top of apron 8.

According to a second form of embodiment, said presser means 57 consist of resilient flanges disposed at the lateral ends 38 of drive shaft 37. Said flanges, coupled for rotation with this shaft 37, may also be coupled to the cam wheels 39.

By consolidating the dogs 43, 44, 45 as explained hereinabove, their resistance to any distortion is improved considerably.

Advantageously, the dog strength will be greater than the torque of the electric motor driving the drive shaft 37. Thus, in case the apron 8 jammed for any reason, the locking effect would be transmitted to cam wheels 39 and consequently to drive shaft 37, without causing any damage to the electric motor.

During the unrolling phase, the various shutter blades 9, 10, 11 are prevented by a foremost curved section 59 from abutting the edge 58 of lateral guide members 50, that is, the edge 58 facing the rolling-up and/or rolling shaft 36.

However, to prevent the rolling shutter 5 from striking too abruptly the sash frame 2 of the roof window 1 after the shutter has been fully raised, the rolling shutter is provided with damping means 60. The damping means 60 are located in each lower ends 61 of guide rails 13 and their function is to balance and compensate the weight of the rolling shutter 5 after its rotation around the axis of rotation 30. Thus, the rolling shutter 5 preserves its position selected by the user. To lower the rolling shutter 5 the user must exert a tractive effort on purpose.

The damping means 60 consist of a carriage 62 comprising rollers 63, 64 movable in a cavity 65 formed in each lower end 61 of the pair of lateral guide rails 13. The upper end of carriage 62 is coupled to the end 67 of a resilient member 68 having its other end 69 coupled to a stop member 70 secured to said guide rails 13.

Damping means 60 and rolling shutter 5 are related by means of control of 72, which is secured to the lower end 71 of carriage 62. Control lug 72 engages a roller 73 rotatably mounted on a hinge pin 74 fixed to the lower end 75 of the pivotably mounted leaf 76 of window 1.

Rolling shutter 5 rotates around axis of rotation 30; the path of lower end 61 of guide rails 13 defines arc 78 during the rotation of rolling shutter 5. Hinged leaf 76 rotates around axis of rotation 3; correspondingly, the path of hinge pin 74 defines arc 77 during the rotation of hinged leaf 76.

When the rolling shutter 5 is in its closed or turned-down position in which it is supported by the sash frame 2 of roof window 1, the resilient member 68 is stressed. The radius of arc 77 is shorter than the radius of arc 78. Correspondingly, the distance between these arcs increases as their distance from sash frame 2 increases.

Accordingly, when the rolling shutter 5 and the hinged leaf 76, are simultaneously raised, the distance between the hinge pin 74 of roller 73 and the lower ends 61 of guide rails 13 tends to increase. Due to the action of the prestressed resilient member 68, the control lug 72 is kept in contact with roller 73. During the rotation of rolling shutter 5 and hinged leaf 76 away from sash frame 2, roller 73, because of the shorter rotation arc of hinge pin 74, allows the carriage 62 to fall back move towards the stop 70. Because the movement of carriage 62 towards stop 70 allows resilient member 68 to contract, the force exerted by the resilient member 68 decreases and this member 68 resumes its inoperative position as the opening movement takes place.

Conversely, when the assembly is lowered, the roller 73 exerts a thrust against the control lug 72 and the resilient member 68 is stressed again. Accordingly, the force acting against the lowering of rolling shutter 5 and hinged leaf 76 increases.

The force of this resilient member 68 may be predetermined or preset as a function of the weight of the rolling shutter 5 to balance this shutter, but the use of a resilient member 68 capable of balancing not only the weight of the rolling shutter 5 but also that of the hinged leaf 76 may also be contemplated.

Though a specific form of embodiment of the present invention has been described and illustrated by way of example herein, it will be readily understood that various modifications may be brought to the relative dimensions and arrangement of the component elements of the rolling shutter structure and control mechanism without departing from the basic principles of the invention.

What is claimed as new is:

1. The rolling shutter for a roof window, comprising:

(a) an apron adapted for substantial displacement and comprising a plurality of adjacent blades, each of said blades comprising;

(i) a lateral end;

(ii) a plurality of dogs projecting from said lateral end, adjacently situated dogs being separated by a variable distance;

(b) a first rotating shaft, onto which said apron is wound, and from which said apron is unwound;

(c) a second rotating shaft, situated downstream of said first rotating shaft, for driving said apron underneath said second rotating shaft to wind onto and unwind from said first rotating shaft;

(d) a cam wheel mounted at one end of said second shaft, said cam wheel comprising radial teeth for engaging said dogs, said radial teeth providing a backlash consistent with said variable distance separating said adjacently situated dogs;

(e) forced guide means:

(i) for facilitating said apron to reverse its winding direction between said first rotating shaft and said second rotating shaft; and (ii) for guiding said apron upwardly to wind onto and unwind from the top of said first rotating shaft;

at least a portion of said forced guide means being situated between said first rotating shaft and said second rotating shaft;

(f) a casing enclosing said first rotating shaft, said second rotating shaft, and said forced guide means, said casing being pivotably mountable, by a first axis situated upstream of said first rotating shaft, on a sash frame of said roof window, and said casing comprising:

(i) a bottom surface adapted to be situated below the plane of the top surface of said sash frame; and (ii) a lateral guide rail for guiding said apron, said lateral guide rail having an upper end and a lower end, and each of said blades being slideably engaged in said lateral guide rail;

wherein said lateral end of each of said blades is slideably engaged, for guiding said apron;

(g) a lug for securing said casing to said sash frame; and (h) damping means for maintaining said rolling shutter, when pivotably mounted on said sash frame, in the position to which it has been pivoted, said damping means being situated at the lower end of said lateral guide rail.

2. The rolling shutter as defined by claim 1 wherein said first axis comprises a hinge shaft extending through said casing and mounted on said lug.

3. The rolling shutter as defined by claim 1 wherein said first axis comprises a stub shaft, projecting from lateral walls of said casing and mounted on said lug.

4. The rolling shutter as defined by claim 1 wherein said damping means is adapted for cooperating with a leaf pivotably mounted, by a second axis, on said sash frame, said damping means comprising:

(a) a carriage having an upper end and a lower end, said carriage being mounted on first rollers which roll in a first groove situated in said lower end of said lateral guide rail;

(b) a resilient member connecting said upper end of said carriage to a stop mounted on said lateral guide rail;

(c) a control lug mounted on said lower end of said carriage, said control lug being adapted:

(i) to be pushed away from said stop by a second roller rotatably mounted on said pivotably mounted leaf; and (ii) to be kept in contact with said second roller by said resilient member, so that upon the pivoting of said rolling shutter and said pivotably mounted leaf away from said second sash frame, said second roller permits said resilient member to pull said carriage toward said stop, said resilient member exerting a force which decreases as said carriage moves toward said stop; and upon the pivoting of said rolling shutter and said pivotably mounted leaf toward said second sash frame, said second roller pushes said carriage away from said stop, said resilient member exerting a force which increases as said carriage moves away from said stop.

5. The rolling shutter as defined by claim 4 wherein said resilient member exerts a force sufficient to balance the weight of said rolling shutter exclusively.

6. The rolling shutter as defined by claim 4 wherein said resilient member exerts a force sufficient to balance both the weight of said rolling shutter and the weight of said pivotably mounted leaf.

7. The rolling shutter as defined by claim 1 wherein said forced guide means comprises a lateral guide member, said lateral guide member comprising:

(a) a straight section located farthest from said first rotating shaft and extending towards said first rotating shaft;

(b) a curved section ascending from said straight section towards said first rotating shaft, the upper surface of said curved section partially following the contour of said cam wheel;

(c) a rounded edge extending from said curved section towards said first rotating shaft; and (d) an end face adjacent said rounded edge, located closest to and facing said first rotating shaft.

8. The rolling shutter as defined by claim 7 wherein said lateral guide member forms a second groove into which said radial teeth of said cam wheel protrudes, said lateral guide member comprising:

(a) a support ramp for slideably engaging said dogs; and (b) a surface of said lateral guide member for slideably engaging said apron.

9. The rolling shutter as defined by claim 8 wherein said support ramp and said surface of said lateral guide member are spaced apart to form said second groove.

10. The rolling shutter as defined by claim 8 wherein said second rotating shaft comprises pressing means for maintaining slideable engagement between said dogs and said support ramp.

11. The rolling shutter as defined by claim 10 wherein said pressing means comprises at least one resilient sleeve, rotatably fitted on said second rotating shaft, for exerting pressure against said apron.

* * * * *

UNITED STATES PATENT AND TRADEMARK OFFICE

CERTIFICATE OF CORRECTION

PATENT NO. : 4,760,873

DATED : August 2, 1988

INVENTOR(S) : Richard BUBENDORFF

It is certified that error appears in the above-identified patent and that said Letters Patent is hereby corrected as shown below:

Column 6, line 21, delete "move".
Column 3, line 41, change "abute" to ---abut---.
Column 4, line 15, delete "of" (second occurrence).

Signed and Sealed this

Thirtieth Day of May, 1989

*Attest:*

DONALD J. QUIGG

*Attesting Officer*

*Commissioner of Patents and Trademarks*